US011270625B2

(12) United States Patent
Wu et al.

(10) Patent No.: US 11,270,625 B2
(45) Date of Patent: Mar. 8, 2022

(54) DISPLAY PANEL AND DISPLAY DEVICE

(71) Applicant: TCL CHINA STAR OPTOELECTRONICS TECHNOLOGY CO., LTD., Guangdong (CN)

(72) Inventors: Yu Wu, Guangdong (CN); Geng Wang, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 196 days.

(21) Appl. No.: 16/620,937

(22) PCT Filed: Nov. 12, 2019

(86) PCT No.: PCT/CN2019/117665
§ 371 (c)(1),
(2) Date: Dec. 10, 2019

(87) PCT Pub. No.: WO2021/082072
PCT Pub. Date: May 6, 2021

(65) Prior Publication Data

US 2021/0335204 A1 Oct. 28, 2021

(30) Foreign Application Priority Data

Oct. 28, 2019 (CN) ..... 201911028537.8

(51) Int. Cl.
*G09G 3/00* (2006.01)
*G09G 3/20* (2006.01)

(52) U.S. Cl.
CPC ... *G09G 3/2092* (2013.01); *G09G 2310/0254* (2013.01); *G09G 2310/0278* (2013.01)

(58) Field of Classification Search
CPC ..... G09G 3/2092; G09G 2310/0254; G09G 2310/0278
See application file for complete search history.

(56) References Cited

U.S. PATENT DOCUMENTS

| | | | | |
|---|---|---|---|---|
| 10,643,558 | B2 | 5/2020 | Su et al. | |
| 2015/0091864 | A1* | 4/2015 | Reynolds | G06F 3/0445 345/174 |
| 2018/0204531 | A1* | 7/2018 | Su | G09G 3/3614 |
| 2019/0057662 | A1* | 2/2019 | Xu | G09G 3/3677 |
| 2020/0258460 | A1 | 8/2020 | Ma | |

FOREIGN PATENT DOCUMENTS

| | | | |
|---|---|---|---|
| CN | 105702226 | A | 6/2016 |
| CN | 106154668 | A | 11/2016 |
| CN | 108761938 | A | 11/2018 |
| CN | 110320719 | A | 10/2019 |
| KR | 20140122123 | A | 10/2014 |

* cited by examiner

*Primary Examiner* — Michael A Faragalla

(57) ABSTRACT

The present application provides a display panel and a display device, wherein in the display panel, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state, thereby alleviating the technical problems that the existing display panel cannot satisfy the user's pursuit of display quality.

18 Claims, 3 Drawing Sheets

DISPLAY PANEL AND DISPLAY DEVICE

BACKGROUND OF INVENTION

Field of Invention

The present application relates to a field of display technologies, and in particular, to a display panel and a display device.

Description of Prior Art

With the constant pursuit of display quality by users, display panels of clearer image quality (such as 8K) and faster refresh rate have become a new trend.

However, a display panel of 8K or higher resolution means more pixels to be driven for a drive system, and a charging time of each pixel is reduced by half compared to a display panel of 4K; in addition, a requirement for a faster refresh rate will further reduce a charging time of the pixels, causing a series of image quality problems.

That is, the existing display panel cannot satisfy the user's pursuit of display quality.

SUMMARY OF INVENTION

The present application provides a display panel and a display device to alleviate the technical problems that the existing display panel cannot satisfy the user's pursuit of display quality.

In order to solve the above problems, technical solutions provided by the present application are as follows:

An embodiment of the present application provides a display panel, including:

sub-pixels arranged in an array;

scan lines configured to output scan signals to the sub-pixels;

data lines configured to output data signals to the sub-pixels;

a gate driver connected to the sub-pixels through the scan lines, and configured to output the scan signals; and a source driver connected to the sub-pixels through the data lines, and configured to output the data signal, wherein, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state.

In a display panel provided by the present application, the sub-pixels connected to a same one of the data lines have a same driving polarity and a same display state.

In the display panel provided by the present application, the display panel includes a pixel combination having repeatedly arranged arrays, the pixel combination including 1st to 16th sub-pixels located in adjacent two rows, and connected to a same one of scan signal output ports; the 1st, 4th, 6th, 17th, 10th, 11th, 13th, and 16th sub-pixels have a same driving polarity, remaining of the sub-pixels have a same driving polarity, and the 1st and 2nd sub-pixels have different driving polarities; and the 1st, 3th, 15th, 17th, 10th, 12th, 14th, and 16th sub-pixels have a same display state, remaining of the sub-pixels have a same display state, and the 1st and 2nd sub-pixels have different display states.

In the display panel provided by the present application, the driving polarities of the 1st sub-pixels to the 16th sub-pixels are sequentially positive, negative, negative, positive, negative, positive, positive, negative, negative, positive, positive, negative, positive, negative, negative, and positive.

In the display panel provided by the present application, the driving polarities of the 1st sub-pixels to the 16th sub-pixels are sequentially negative, positive, positive, negative, positive, negative, negative, positive, positive, negative, negative, positive, negative, positive, positive, and negative.

In the display panel provided by the present application, display states of the 1st sub-pixels to the 16th sub-pixels are sequentially bright, dark, bright, dark, bright, dark, bright, dark, dark, bright, dark, bright, dark, bright, dark, and bright.

In the display panel provided by the present application, the display states of the 1st sub-pixels to the 16th sub-pixels are sequentially dark, bright, dark, bright, dark, bright, dark, bright, bright, dark, bright, dark, bright, dark, bright, and dark.

In the display panel provided by the present application, the 1st to 16th sub-pixels are connected to a same one of the scan lines.

In the display panel provided by the present application, the sub-pixels located in a 1st row are connected to a 1st scan line, the sub-pixels located in a 2nd row are connected to a 2nd scan line, and the 1st scan line and the 2nd scan line are connected to a same one of the scan signal output ports of the gate driver.

The present application also provides a display device including a display panel, the display panel including:

sub-pixels arranged in an array;

scan lines configured to output scan signals to the sub-pixels;

data lines configured to output data signals to the sub-pixels;

a gate driver connected to the sub-pixels through the scan lines, and configured to output the scan signals; and a source driver connected to the sub-pixels through the data lines, and configured to output the data signal, wherein, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state.

In the display device provided by the present application, the sub-pixels connected to a same one of the data lines have a same driving polarity and a same display state.

In the display device provided by the present application, the display panel includes a pixel combination having repeatedly arranged arrays, the pixel combination including 1st to 16th sub-pixels located in adjacent two rows, and connected to a same one of scan signal output ports;

the 1st, 4th, 6th, 17th, 10th, 11th, 13th, and 16th sub-pixels have a same driving polarity, remaining of the sub-pixels have a same driving polarity, and the 1st and 2nd sub-pixels have different driving polarities; and the 1st, 3th, 15th, 17th, 10th, 12th, 14th, and 16th sub-pixels have a same display state, remaining of the sub-pixels have a same display state, and the 1st and 2nd sub-pixels have different display states.

In the display device provided by the present application, the driving polarities of the 1st sub-pixels to the 16th sub-pixels are sequentially positive, negative, negative, positive, negative, positive, positive, negative, negative, positive, positive, negative, positive, negative, negative, and positive.

In the display device provided by the present application, the driving polarities of the 1st sub-pixels to the 16th sub-pixels are sequentially negative, positive, positive, negative, positive, negative, negative, positive, positive, negative, negative, positive, negative, positive, positive, and negative.

In the display device provided by the present application, display states of the 1st sub-pixels to the 16th sub-pixels are sequentially bright, dark, bright, dark, bright, dark, bright, dark, dark, bright, dark, bright, dark, bright, dark, and bright.

In the display device provided by the present application, the display states of the 1st sub-pixels to the 16th sub-pixels are sequentially dark, bright, dark, bright, dark, bright, dark, bright, bright, dark, bright, dark, bright, dark, bright, and dark.

In the display device provided by the present application, the 1st to 16th sub-pixels are connected to a same one of the scan lines.

In the display device provided by the present application, the sub-pixels located in a 1st row are connected to a 1st scan line, the sub-pixels located in a 2nd row are connected to a 2nd scan line, and the 1st scan line and the 2nd scan line are connected to a same one of the scan signal output ports of the gate driver.

In the display device provided by the present application, luminous colors of the sub-pixels of all rows are repeatedly arranged in a same manner.

In the display device provided by the present application, luminous colors of the sub-pixels of adjacent rows are repeatedly arranged in different manners.

The present application has the following advantages: the present application provides a display panel including sub-pixels arranged in an array; scan lines configured to output scan signals to the sub-pixels; data lines configured to output data signals to the sub-pixels; a gate driver connected to the sub-pixels through the scan lines, and configured to output the scan signals; and a source driver connected to the sub-pixels through the data lines, and configured to output the data signal, wherein, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state. The present application introduces different display states to ensure the fineness of the image quality of the display panel. In a periodic unit, the data lines and a common electrode are offset from each other in positive and negative directions, and there is no crosstalk problem, that is, the display panel provided by the present application improves the quality of the large viewing angle of the panel under conditions of weak graininess, no flicker, no crosstalk and low power consumption, and alleviates the technical problems that the existing display panel cannot satisfy the user's pursuit of display quality.

BRIEF DESCRIPTION OF DRAWINGS

In order to more clearly illustrate the embodiments or the technical solutions of the existing art, the drawings illustrating the embodiments or the existing art will be briefly described below. Obviously, the drawings in the following description merely illustrate some embodiments of the present invention. Other drawings may also be obtained by those skilled in the art according to these figures without paying creative work.

DETAILED DESCRIPTION OF PREFERRED EMBODIMENTS

The following description of the various embodiments is provided to illustrate the specific embodiments of the invention. The spatially relative directional terms mentioned in the present invention, such as "upper", "lower", "before", "after", "left", "right", "inside", "outside", "side", etc. and the like, may be used herein for ease of description to describe one element or feature's relationship to another element(s) or feature(s) as illustrated in the figures which are merely references. The spatially relative terms are intended to encompass different orientations in addition to the orientation as depicted in the figures.

The display panel provided by the present application can alleviate the technical problems that the existing display panel cannot satisfy the user's pursuit of display quality.

Figure 1:
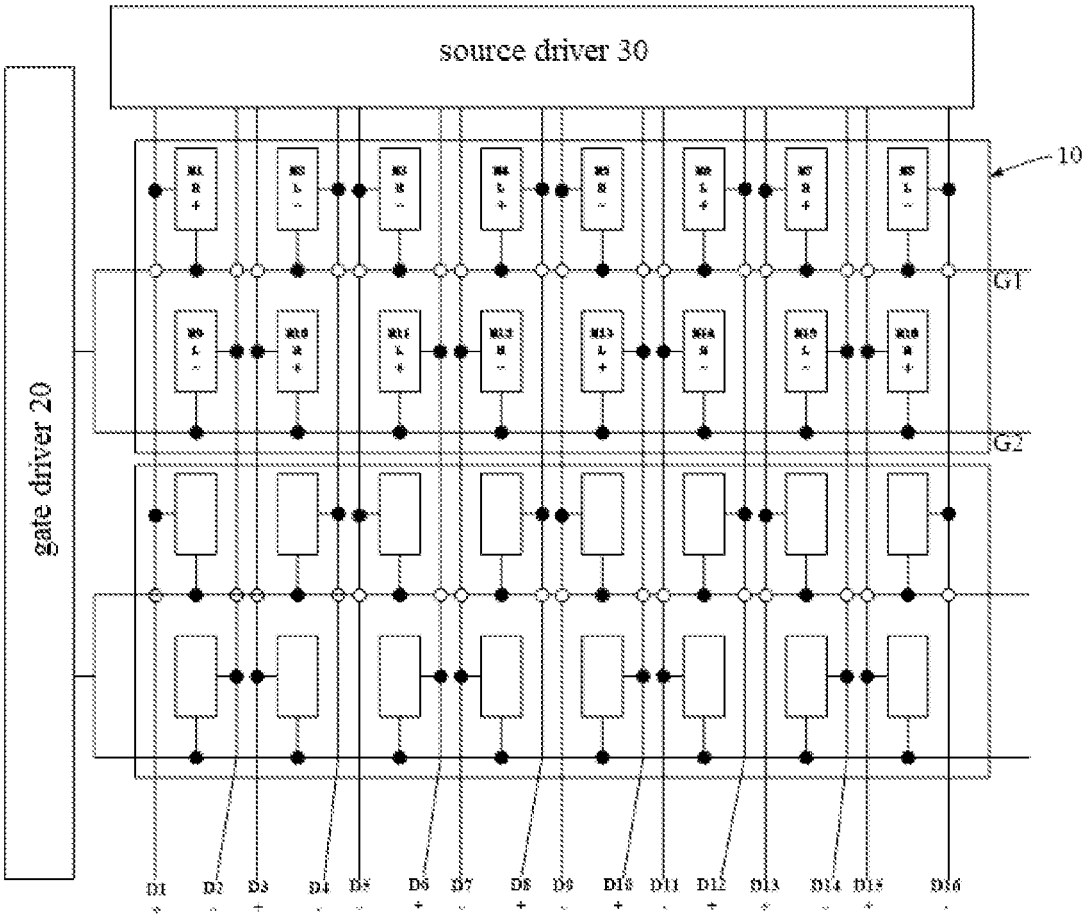
FIG. 1 is a schematic structural diagram of a display panel according to an embodiment of the present application.

In an embodiment, as shown in FIG. 1, the display panel provided by the present application includes:

sub-pixels M arranged in the array (including M1, M2, . . . etc. as shown in FIG. 1);

scan lines (including G1, G2, . . . etc. as shown in FIG. 1) configured to output scan signals to the sub-pixels M;

data lines (including D1, D2, . . . etc. as shown in FIG. 1) configured to output data signals to the sub-pixels M;

a gate driver 20*r* connected to the sub-pixels through the scan lines, and configured to output the scan signals;

a source driver 30 connected to the sub-pixels through the data lines, and configured to output the data signal;

wherein, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state.

The display panel provided in an embodiment of the present application introduces different display states to ensure the fineness of the image quality of the display panel. In a periodic unit, the data lines and a common electrode are offset from each other in positive and negative directions, and there is no crosstalk problem, that is, the display panel provided by the present application improves the quality of the large viewing angle of the panel under conditions of weak graininess, no flicker, no crosstalk and low power consumption, and alleviates the technical problems that the existing display panel cannot satisfy the user's pursuit of display quality.

In an embodiment, as shown in FIG. 1, the sub-pixels connected to a same one of the data lines have a same driving polarity and a same display state.

In an embodiment, as shown in FIG. 1, the display panel includes a pixel combination having repeatedly arranged arrays, the pixel combination including 1st to 16th sub-pixels located in adjacent two rows, and connected to a same one of scan signal output ports;

the 1st, 4th, 6th, 17th, 10th, 11th, 13th, and 16th sub-pixels have a same driving polarity, remaining of the sub-pixels have a same driving polarity, and the 1st and 2nd sub-pixels have different driving polarities; and the 1st, 3th, 15th, 17th, 10th, 12th, 14th, and 16th sub-pixels have a same display state, remaining of the sub-pixels have a same display state, and the 1st and 2nd sub-pixels have different display states.

In an embodiment, as shown in FIG. 1, the pixel combination 10 includes a 1st sub-pixel M1, a 2nd sub-pixel M2, a 3th sub-pixel M3, and a 4th sub-pixel M4 located in a 1st row. a 5th sub-pixel M5, a 6th sub-pixel M6, a 7th sub-pixel M7, and an 8th sub-pixel M8 which are adjacently arranged in a 1st row, and a 9th sub-pixel M9, a 10th sub-pixel M10, and an 11th sub-pixel, a 12th sub-pixel M12, a 13th sub-pixel M13, a 14th sub-pixel M14, a 15th sub-pixel M15, and a 16th sub-pixel M16 which are adjacently arranged in a 2nd row. The 1st row and the 2nd are adjacent to each other, the 1st sub-pixel and the 9th sub-pixel are located in a same column, the 2nd sub-pixel and the 10th sub-pixel are located in a same column, the 3th sub-pixel and the 11th sub-pixel are located in a same column, the 4th sub-pixel and the 12th sub-pixel are located in a same column, the 5th sub-pixel and the 13th sub-pixel are located in a same column, the 6th sub-pixel and the 14th sub-pixels are located in a same column, the 7th sub-pixel and the 15th sub-pixel are located in a same column, and the 8th sub-pixel and the 16th sub-pixels are located in a the same column;

the 1st sub-pixel to the 16th sub-pixel are connected to a same one of scan signal output ports of the gate driver through the scan lines;

the data lines include a 1st data line to a 16th data line that are repeatedly arranged;

the 1st data line D1 is connected to the 1st sub-pixel, a 2nd data line D2 is connected to the 9th sub-pixel, a 3th data line D3 is connected to the 10th sub-pixel, a 4th data line D4 is connected to the 2nd sub-pixel, a 5th data line D5 is connected to the 3th sub-pixel, a 6th data line D6 is connected to the 11th sub-pixel, a 7th data line D7 is connected to the 12th sub-pixel, a 8th data line D8 is connected the 4th sub-pixel, a 9th data line D9 is connected to the 5th sub-pixel, a 10th data line D10 is connected to the 13th sub-pixel, a 11th data line D11 is connected to the 14th sub-pix, a 12th data line D12 is connected to the 6th sub-pixel, a 13th data line D13 is connected to the 7th sub-pixel, a 14th data line D14 is connected to the 15th sub-pixel, a 15th data line D15 is connected to the 16th sub-pixel, and a 16th data line D16 is connected to the 8th sub-pixel;

the 1st data line, the 3th data line, the 6th data line, the 8th data line, the 10th data line, the 12th data line, the 13th data line, and the 15th data line have a same driving polarity; the 2nd data line, the 4th data line, the 5th data line, the 7th data line, the 9th data line, the 11th data line, the 14th data line, and the 16th data line have a same driving polarity, and the driving polarities of the 1st data line and the 2nd data line are opposite; and the 1st sub-pixel, the 3th sub-pixel, the 5th sub-pixel, the 7th sub-pixel, the 10th sub-pixel, the 12th sub-pixel, and the 14th sub-pixel, and the 16th sub-pixel have a same display state, the 2nd sub-pixel, the 4th sub-pixel, the 6th sub-pixel, the 8th sub-pixel, the 9th sub-pixel, the 11th sub-pixel, the 13th sub-pixel, and the 15th sub-pixel have a same display state, and the display states of the 1st sub-pixel and the 2nd sub-pixel are different.

In an embodiment, as shown in FIG. 1, the driving polarities of the 1st sub-pixel to the 16th sub-pixel are sequentially positive (+), negative (−), negative (−), positive (+), and negative, respectively. (−), positive (+), positive (+), negative (−), negative (−), positive (+), positive (+), negative (−), positive (+), negative (−), negative (−), and positive (+).

In an embodiment, as shown in FIG. 1, the display states of the 1st sub-pixel to the 16th sub-pixel are sequentially bright H, dark L, bright H, dark L, bright H, dark L, and bright H, dark L, dark L, bright H, dark L, bright H, dark L, bright H, dark L, and bright H.

As shown in FIG. 1, the scan lines G1 and G2 are turned on at the same time, and meanwhile, the input data signal of the data line D1 has a positive driving polarity, the input data signal of the data line D1 controls the 1st sub-pixel M1 to be in a bright state, and a voltage of the 1st sub-pixel M1 in the bright state is H+;

the input data signal of the data line D2 has a negative driving polarity, the input data signal of the data line D2 controls the 9th sub-pixel M9 to be in a dark state, and a voltage of the 9th sub-pixel M9 in the dark state is L−;

the input data signal of the data line D3 has a positive driving polarity, the input data signal of the data line D3 controls the 10th sub-pixel M10 to be in a bright state, and the voltage of the 10th sub-pixel M10 in the bright state is H+;

the input data signal of the data line D4 has a negative driving polarity, the input data signal of the data line D4 controls the 2nd sub-pixel M2 to be in a dark state, and a voltage of the 2nd sub-pixel M2 in the dark state is L−;

the input data signal of the data line D5 has a negative driving polarity, the input data signal of the data line D5 controls the 3th sub-pixel M3 to be in a bright state, and a voltage of the 3th sub-pixel M3 in the bright state is H−;

the input data signal of the data line D6 has a positive driving polarity, the input data signal of the data line D6 controls the 11th sub-pixel M11 to be in a dark state, and a voltage of the 11th sub-pixel M11 in the dark state is L+;

the input data signal of the data line D7 has a negative driving polarity, the input data signal of the data line D7 controls the 12th sub-pixel M12 to be in a bright state, and a voltage of the 12th sub-pixel M12 in the bright state is H−;

the input data signal of the data line D8 has a positive driving polarity, and the input data signal of the data line D8 controls the 4th sub-pixel M4 to be in a dark state, and a voltage of the 4th sub-pixel M4 in the dark state is L+;

the input data signal of the data line D9 has a negative driving polarity, the input data signal of the data line D9 controls the 5th sub-pixel M5 to be in a bright state, and a voltage of the 5th sub-pixel M5 in the bright state is H−;

the input data signal of the data line D10 has a positive driving polarity, the input data signal of the data line D10 controls the 13th sub-pixel M13 to be in a dark state, and a voltage of the dark state 13th sub-pixel M13 in the dark state in L+;

the input data signal of the data line D11 has a negative driving polarity, the input data signal of the data line D11 controls the 14th sub-pixel M14 to be in a bright state, and a voltage of the 14th sub-pixel M14 in the bright state is H−;

the input data signal of of the data line D12 has a positive driving polarity, and the input data signal of the data line D12 controls the 6th sub-pixel M6 to be in a dark state, and a voltage of the 6th sub-pixel M6 in the dark state is L+;

the input data signal of the data line D13 has a positive driving polarity, and the input data signal of the data line D13 controls the 7th sub-pixel M7 to be in a bright state, and a voltage of the 7th sub-pixel M7 in the bright state is H+;

the input data signal of the data line D14 has a negative driving polarity, the input data signal of the data line D14 controls the 15th sub-pixel M15 to be in a dark state, and a voltage of the 15th sub-pixel M15 in the dark state is L−;

the input data signal of the data line D15 has a positive driving polarity, the input data signal of the data line D15 controls the 16th sub-pixel M16 to be in a bright state, and a voltage of the 16th sub-pixel M16 in the bright state is H+; and the input data signal of the data line D16 has a negative driving polarity, the input data signal of the data line D16 controls the 8th sub-pixel M8 to be in a dark state, and a voltage of the 8th sub-pixel M8 in the dark state is L−.

In an embodiment, the driving polarities of the 1st sub-pixel to the 16th sub-pixel are sequentially negative, positive, positive, negative, positive, negative, negative, positive, positive, negative, negative, positive, negative, positive, positive, and negative.

In an embodiment, the display states of the 1st sub-pixel to the 16th sub-pixel are sequentially dark, light, dark, bright, dark, bright, dark, bright, bright, dark, bright, dark, bright, dark, bright, and dark.

In an embodiment, the 1st to 16th sub-pixels are connected to a same one of the scan lines.

In an embodiment, as shown in FIG. 1, the sub-pixels located in the 1st row are connected to the 1st scan line S1, the sub-pixels located in the 2nd row are connected to the 2nd scan line S2, and the 1st scan line and the 2nd scan line are connected to a same one of the scan signal output ports of the gate driver.

In an embodiment, as shown in FIG. 1, the luminous colors of the sub-pixels of all rows are repeatedly arranged in a same manner, that is, the display panels are arranged in a true pixel manner.

In an embodiment, in the illustrated display panel, a number of columns of the sub-pixels is an integer multiple of 24, and a number of rows of the sub-pixels is an integer multiple of 2.

In an embodiment, as shown in FIG. 1, the red sub-pixel, the blue sub-pixel, and the green sub-pixel are repeatedly arranged in a row direction.

In an embodiment, the red sub-pixel, the green sub-pixel, and the blue sub-pixel are repeatedly arranged in a row direction.

In an embodiment, the sub-pixels of adjacent rows have different repeatedly arrangements of the luminous colors, that is, the display panel is arranged in a virtual pixel manner, which increases a resolution of the display panel.

Based on the display panel shown in FIG. 1, the sub-pixels of two adjacent rows share a same one of the scan signal output ports, that is, a pixel combination of a same row uses a same one of the scan signal output ports, and can be charged at the same time, to realize increase in a charging time. The display states (bright state and dark state) of the sub-pixels of a same column alternate at the same time, and different display states are employed, to ensure the fineness of the display panel image quality (weak graininess).

As shown in FIG. 1, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state. Thus, there is no problem with flicker.

As shown in FIG. 1, the sub-pixels connected to a same data line are all in the bright states of a same polarity, or all in the dark states of a same polarity. There is no switching of bright state to dark state, or dark state to bright state achieving a low power consumption effect.

Figure 2:
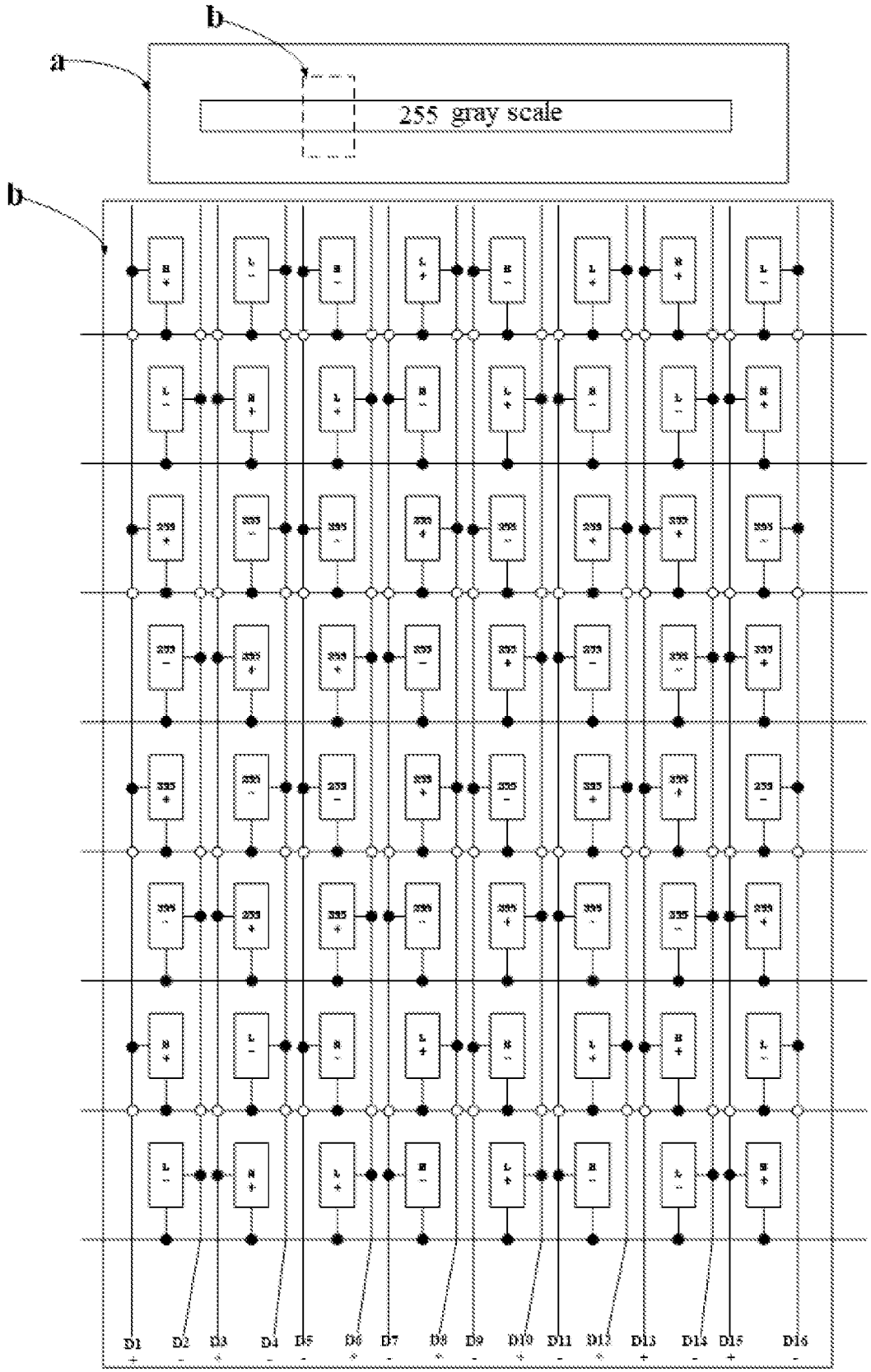
FIG. 2 is a schematic diagram of driving a display panel when a preset image is displayed according to an embodiment of the present application.
Figure 3:
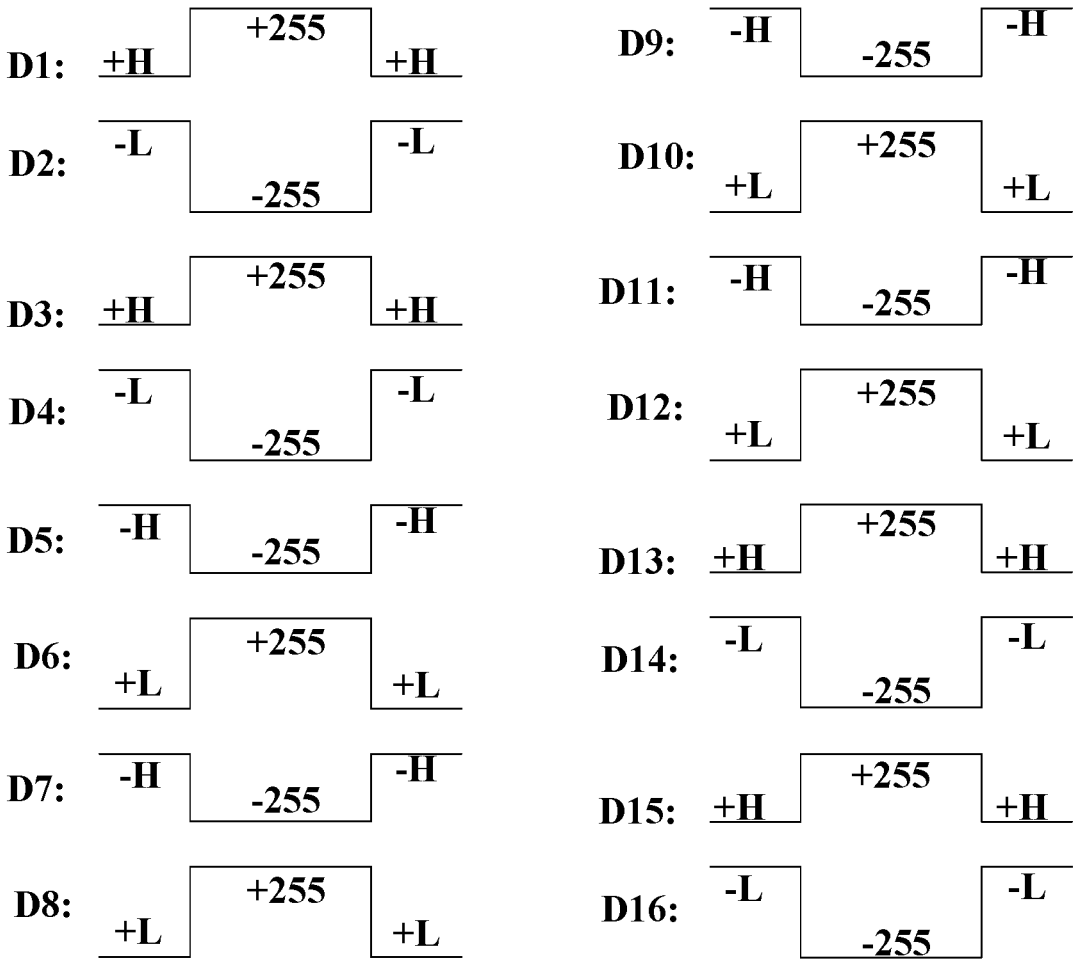
FIG. 3 is a schematic diagram of data line signal changes according to an embodiment of the present application.

As shown in FIG. 2, when the display panel displays the preset image a, the driving voltages of a portion of the sub-pixels are as shown by b in FIG. 2. At this time, data signal changes of each of the data lines are as shown in FIG. 3. In a periodic unit, the data lines and a common electrode are offset from each other in positive and negative directions, and there is no crosstalk problem Meanwhile, in an embodiment, the present application further provides a display device including a display panel, which may be a liquid crystal display or an organic light emitting display, and the display panel includes:

sub-pixels arranged in an array;

scan lines configured to output scan signals to the sub-pixels;

data lines configured to output data signals to the sub-pixels;

a gate driver connected to the sub-pixels through the scan lines, and configured to output the scan signals; and a source driver connected to the sub-pixels through the data lines, and configured to output the data signal, wherein, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state.

In an embodiment, in the display device provided by the present application, the sub-pixels connected to a same one of the data lines have a same driving polarity and a same display state.

In an embodiment, in the display device provided by the present application, the display panel includes a pixel combination having repeatedly arranged arrays, the pixel combination including 1st to 16th sub-pixels located in adjacent two rows, and connected to a same one of scan signal output ports; the 1st, 4th, 6th, 17th, 10th, 11th, 13th, and 16th sub-pixels have a same driving polarity, remaining of the sub-pixels have a same driving polarity, and the 1st and 2nd sub-pixels have different driving polarities; and the 1st, 3th, 15th, 17th, 10th, 12th, 14th, and 16th sub-pixels have a same display state, remaining of the sub-pixels have a same display state, and the 1st and 2nd sub-pixels have different display states.

In an embodiment, in the display device provided by the present application, the driving polarities of the 1st sub-pixels to the 16th sub-pixels are sequentially positive, negative, negative, positive, negative, positive, positive, negative, negative, positive, positive, negative, positive, negative, negative, and positive.

In an embodiment, in the display device provided by the present application, the driving polarities of the 1st sub-pixels to the 16th sub-pixels are sequentially negative, positive, positive, negative, positive, negative, negative, positive, positive, negative, negative, positive, negative, positive, positive, and negative.

In an embodiment, in the display device provided by the present application, display states of the 1st sub-pixels to the 16th sub-pixels are sequentially bright, dark, bright, dark, bright, dark, bright, dark, dark, bright, dark, bright, dark, bright, dark, and bright.

In an embodiment, in the display device provided by the present application, the display states of the 1st sub-pixels to the 16th sub-pixels are sequentially dark, bright, dark, bright, dark, bright, dark, bright, bright, dark, bright, dark, bright, dark, bright, and dark.

In an embodiment, in the display device provided by the present application, the 1st to 16th sub-pixels are connected to a same one of the scan lines.

In an embodiment, in the display device provided by the present application, the sub-pixels located in a 1st row are connected to a 1st scan line, the sub-pixels located in a 2nd row are connected to a 2nd scan line, and the 1st scan line and the 2nd scan line are connected to a same one of the scan signal output ports of the gate driver.

In an embodiment, in the display device provided by the present application, luminous colors of the sub-pixels of all rows are repeatedly arranged in a same manner.

In an embodiment, in the display device provided by the present application, the red sub-pixel, the blue sub-pixel, and the green sub-pixel are repeatedly arranged in a row direction.

In an embodiment, in the display device provided by the present application, luminous colors of the sub-pixels of adjacent rows are repeatedly arranged in different manners.

According to the above embodiment, it can be known that:

The present application provides a display panel including sub-pixels arranged in an array; scan lines configured to output scan signals to the sub-pixels; data lines configured to output data signals to the sub-pixels; a gate driver connected to the sub-pixels through the scan lines, and configured to output the scan signals; and a source driver connected to the sub-pixels through the data lines, and configured to output the data signal, wherein, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state. The present application introduces different display states to ensure the fineness of the image quality of the display panel. In a periodic unit, the data lines and a common electrode are offset from each other in positive and negative directions, and there is no crosstalk problem, that is, the display panel provided by the present application improves the quality of the large viewing angle of the panel under conditions of weak graininess, no flicker, no crosstalk and low power consumption, and alleviates the technical problems that the existing display panel cannot satisfy the user's pursuit of display quality.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A display panel, comprising:

sub-pixels arranged in an array;

scan lines configured to output scan signals to the sub-pixels;

data lines configured to output data signals to the sub-pixels;

a gate driver connected to the sub-pixels through the scan lines, and configured to output the scan signals; and a source driver connected to the sub-pixels through the data lines, and configured to output the data signal, wherein, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state; and wherein the display panel comprises a pixel combination having repeatedly arranged arrays, the pixel combination comprising 1st to 16th sub-pixels located in adjacent two rows, and connected to a same one of scan signal output ports; the 1st, 4th, 6th, 17th, 10th, 11th, 13th, and 16th sub-pixels have a same driving polarity, remaining of the sub-pixels have a same driving polarity, and the 1st and 2nd sub-pixels have different driving polarities; and the 1st, 3rd, 15th, 17th, 10th, 12th, 14th, and 16th sub-pixels have a same display state, remaining of the sub-pixels have a same display state, and the 1st and 2nd sub-pixels have different display states.

2. The display panel according to claim 1, wherein the sub-pixels connected to a same one of the data lines have a same driving polarity and a same display state.

3. The display panel according to claim 1, wherein the driving polarities of the 1st sub-pixels to the 16th sub-pixels are sequentially positive, negative, negative, positive, negative, positive, positive, negative, negative, positive, positive, negative, positive, negative, negative, and positive.

4. The display panel according to claim 1, wherein the driving polarities of the 1st sub-pixels to the 16th sub-pixels are sequentially negative, positive, positive, negative, positive, negative, negative, positive, positive, negative, negative, positive, negative, positive, positive, and negative.

5. The display panel according to claim 1, wherein display states of the 1st sub-pixels to the 16th sub-pixels are sequentially bright, dark, bright, dark, bright, dark, bright, dark, dark, bright, dark, bright, dark, bright, dark, and bright.

6. The display panel according to claim 1, wherein the display states of the 1st sub-pixels to the 16th sub-pixels are sequentially dark, bright, dark, bright, dark, bright, dark, bright, bright, dark, bright, dark, bright, dark, bright, and dark.

7. The display panel of claim 1, wherein the 1st to 16th sub-pixels are connected to a same one of the scan lines.

8. The display panel of claim 1, wherein the sub-pixels located in a 1st row are connected to a 1st scan line, the sub-pixels located in a 2nd row are connected to a 2nd scan line, and the 1st scan line and the 2nd scan line are connected to a same one of the scan signal output ports of the gate driver.

9. A display device, comprising a display panel, the display panel comprising:

sub-pixels arranged in an array;

scan lines configured to output scan signals to the sub-pixels;

data lines configured to output data signals to the sub-pixels;

a gate driver connected to the sub-pixels through the scan lines, and configured to output the scan signals; and a source driver connected to the sub-pixels through the data lines, and configured to output the data signal, wherein, in a same display frame, a number of sub-pixels with a positive driving polarity and a bright display state is the same as a number of sub-pixels with a negative driving polarity and a bright display state, and a number of sub-pixels with a positive driving polarity and a dark display state is the same as a number of sub-pixels with a negative driving polarity and a dark display state;

wherein the display panel comprises a pixel combination having repeatedly arranged arrays, the pixel combination comprising 1st to 16th sub-pixels located in adjacent two rows, and connected to a same one of scan signal output ports;

the 1st, 4th, 6th, 17th, 10th, 11th, 13th, and 16th sub-pixels have a same driving polarity, remaining of the sub-pixels have a same driving polarity, and the 1st and 2nd sub-pixels have different driving polarities; and the 1st, 3rd, 15th, 17th, 10th, 12th, 14th, and 16th sub-pixels have a same display state, remaining of the sub-pixels have a same display state, and the 1st and 2nd sub-pixels have different display states.

10. The display device according to claim 9, wherein the sub-pixels connected to a same one of the data lines have a same driving polarity and a same display state.

11. The display device according to claim 9, wherein the driving polarities of the 1st sub-pixels to the 16th sub-pixels are sequentially positive, negative, negative, positive, negative, positive, positive, negative, negative, positive, positive, negative, positive, negative, negative, and positive.

12. The display device according to claim 9, wherein the driving polarities of the 1st sub-pixels to the 16th sub-pixels are sequentially negative, positive, positive, negative, positive, negative, negative, positive, positive, negative, negative, positive, negative, positive, positive, and negative.

13. The display device according to claim 9, wherein display states of the 1st sub-pixels to the 16th sub-pixels are sequentially bright, dark, bright, dark, bright, dark, bright, dark, dark, bright, dark, bright, dark, bright, dark, and bright.

14. The display device according to claim 9, wherein the display states of the 1st sub-pixels to the 16th sub-pixels are sequentially dark, bright, dark, bright, dark, bright, dark, bright, bright, dark, bright, dark, bright, dark, bright, and dark.

15. The display device of claim 9, wherein the 1st to 16th sub-pixels are connected to a same one of the scan lines.

16. The display device according to claim 9, wherein the sub-pixels located in a 1st row are connected to a 1st scan line, the sub-pixels located in a 2nd row are connected to a 2nd scan line, and the 1st scan line and the 2nd scan line are connected to a same one of the scan signal output ports of the gate driver.

17. The display device according to claim 9, wherein luminous colors of the sub-pixels of all rows are repeatedly arranged in a same manner.

18. The display device according to claim 9, wherein luminous colors of the sub-pixels of adjacent rows are repeatedly arranged in different manners.

* * * * *